United States Patent [19]

Pöll

[11] Patent Number: 5,070,586

[45] Date of Patent: Dec. 10, 1991

[54] COMPOUND OF GEMS AND A METHOD OF PRODUCING IT

[75] Inventor: Martin Pöll, Fritzens, Austria

[73] Assignee: D. Swarovski & Co., Wattens, Austria

[21] Appl. No.: 591,449

[22] Filed: Oct. 1, 1990

[30] Foreign Application Priority Data

Oct. 16, 1989 [DE] Fed. Rep. of Germany ..... 3934484

[51] Int. Cl.[5] ..... B23P 5/00

[52] U.S. Cl. ..... 29/10; 29/433; 29/447

[58] Field of Search ..... 29/10, 447, 433; 26/18.5, 18.6

[56] References Cited

U.S. PATENT DOCUMENTS

| | | | |
|---|---|---|---|
| 2,102,746 | 12/1937 | Reilly | 29/433 X |
| 2,141,363 | 12/1938 | Rigollet | 29/10 X |
| 2,362,596 | 11/1944 | Trattler | 29/433 X |
| 2,381,860 | 8/1945 | Baggott | 29/433 X |
| 3,271,499 | 9/1966 | Schwaiger | 29/10 X |
| 3,634,917 | 1/1972 | Kortick | 29/10 |
| 4,411,051 | 10/1983 | Ehemann | 26/18.5 |
| 4,897,902 | 2/1990 | Kauesh et al. | 26/18.5 X |

*Primary Examiner*—Timothy V. Eley
*Assistant Examiner*—C. Richard Martin
*Attorney, Agent, or Firm*—Foley & Lardner

[57] ABSTRACT

A compound of gems consisting of a plurality of gems connected by means of threads made of shrunk synthetic material.

3 Claims, 1 Drawing Sheet

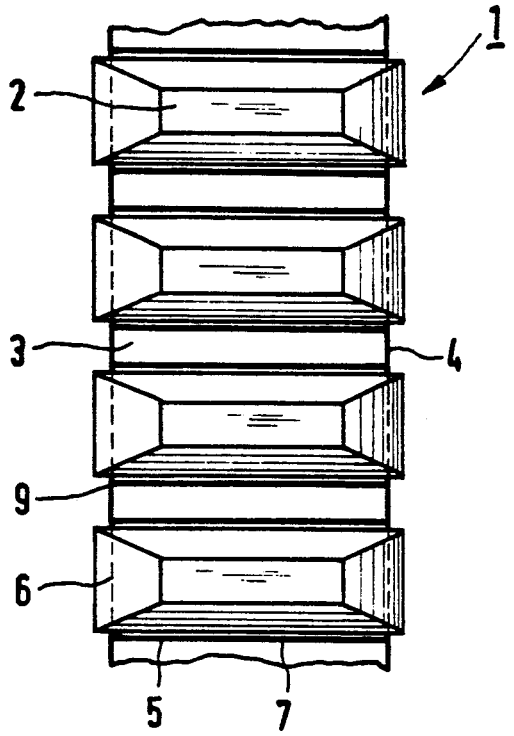
FIG. 1
FIG. 2
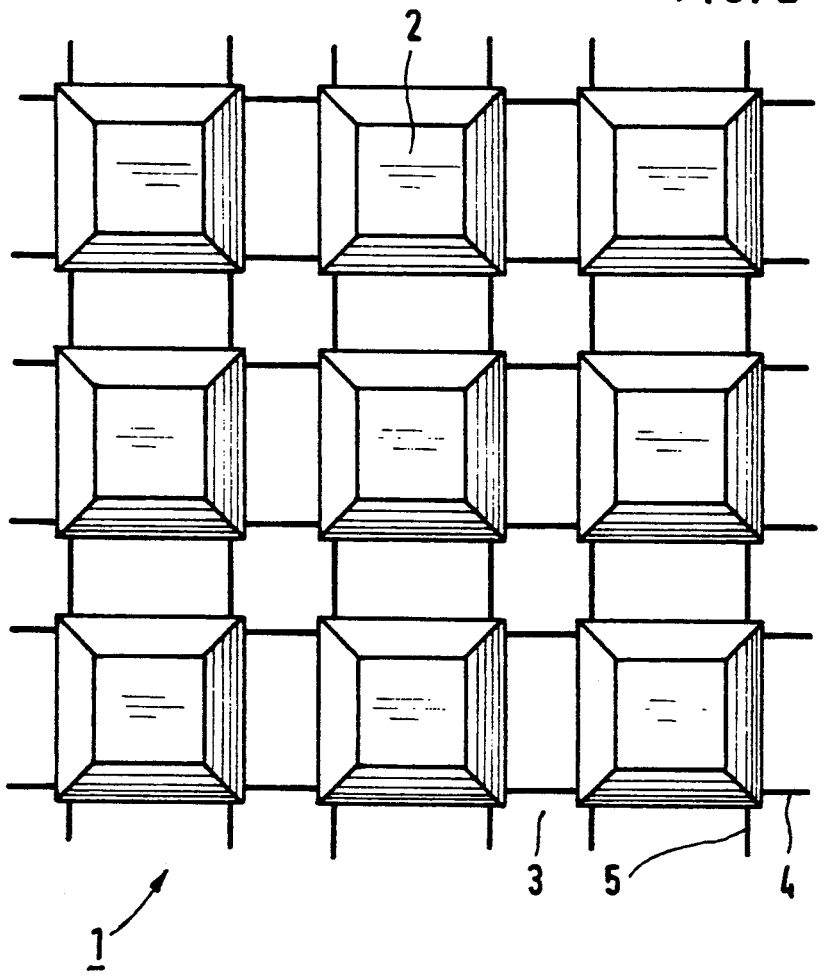

COMPOUND OF GEMS AND A METHOD OF PRODUCING IT

The present invention relates to a compound of gems and to a method of producing it.

A plurality of gems, such as faceted glass stones, were up to now usually connected by providing bores in the gems and hanging two adjacent gems together through the bores by means of metal wire. Such an arrangement is expensive. The bores impair the esthetic impression.

The invention is based on the problems of providing a compound of gems wherein the gems can be connected in a simple way requiring little labor, and the optical impression is not impaired.

The invention is based on the finding that this problem can be solved by connecting the gems using shrinkable synthetic thread.

The object of the invention is a compound of gems characterized in that a plurality of gems disposed side by side and having lateral grooves are held in a grid consisting of longitudinal threads and transverse threads, at least the longitudinal threads or the transverse threads engage the lateral grooves of the gems, and the longitudinal threads and transverse threads are made of shrunk synthetic material.

The object of the invention is also a method for producing a compound of gems characterized by inserting gems having lateral grooves into a grid consisting of longitudinal and transverse threads made of a shrinkable synthetic material so that at least the longitudinal or the transverse threads engage the grooves, and shrinking the threads.

The synthetic threads used are preferably made of shrunk thermoplastic synthetic material. The longitudinal and transverse threads of the grid are preferably welded together at the points of intersection.

The compound of gems can consist of a single row. It is suitable for a great variety of ornamental purposes. Such an arrangement is also suitable for jewelry, for example bracelets.

However, the compound may also have a plurality of rows or a sheetlike arrangement. Such an arrangement can be used for decorating surfaces and in particular also in the lighting industry.

The term "gem" is used here in its most general sense and includes all kinds of gems, relating in particular to faceted glass stones. The form of the gems can be manifold, for example square, rectangular, octagonal, circular or oval. The size of the gems is also variable within wide limits, for example between 5 and 100 mm. The gems can be colored in a great variety of ways. They can exhibit a great variety of cuts.

The gems have lateral grooves for taking up the synthetic threads. The depth and width of the grooves may be between 0.5 and 5 mm, for example. The grooves are adapted to the diameter of the synthetic threads. The thickness of the synthetic threads depends on the size of the gems and the required tensile strength.

Grooves may be provided only on two parallel side surfaces for taking up the longitudinal or the transverse threads. Alternatively, grooves may be provided on all four sides of the gem to take up both the longitudinal and the transverse threads.

The invention shall be explained on more detail with reference to the drawing showing exemplary embodiments.

FIG. 1 shows a single-row compound of gems from the top, and

FIG. 2 shows a sheetlike compound of gems from the top.

FIG. 1 shows that rectangular gems 2 are held by a grid 3 consisting of longitudinal threads 4 and transverse threads 5. Longitudinal threads 4 are disposed in longitudinal grooves 6, while transverse threads 5 extend beside gem 2. Alternatively, transverse threads 5 may also be disposed in transverse grooves 7 (not shown). A further alternative is to dispose only transverse threads 5 in transverse grooves 7 and to direct longitudinal threads 4 on the sides of gems 2.

Longitudinal threads 4 are preferably welded to transverse threads 5 at points of intersection 9. However it is also possible to produce grid 3 integrally by pressing or punching or to glue the transverse and longitudinal threads in a suitable way.

The synthetic threads used are made of shrinkable synthetic material. The grid is dimensioned in such a way that the gems are easy to insert. The synthetic threads snap into the lateral grooves, whereby they can be prevented from falling through if only either the longitudinal threads or the transverse threads come to lie in grooves. For esthetic reasons, however, it may be advantageous if both the transverse threads and the longitudinal threads extend in grooves.

After the gems are inserted in the grid the synthetic threads are subjected to a shrinking process. The shrinkage is usually performed by heat treatment. The cold-worked thermoplastic synthetic threads preferably used contract back to their original state during the heat treatment. Shrinkages of 3 to 5% or considerably more easy to obtain. This strinkage of the synthetic threads achieves a firm hold of the gems in the grid. Preferred synthetic materials that can be subjected to strinkage are polyethylene terephthalate, polyethylene, polyvinyl chloride, polypropylene, polystyrene, polyacrylonitrile, polyamide and polycarbonate. Polyamide is particularly preferred. In some cases one can also use fiber-reinforced synthetic materials.

Oriented or stretched synthetic materials are also preferred due to their high strength.

The suitable shrinking temperatures are selected in accordance with the synthetic material used. For example, the shrinkage can be achieved at temperatures beteen 100° and 120° C. by immersion in a suitably hot liquid.

It is apparent that the type and arrangement of the gems may be manifold. The distances between the gems, their size and their design can be varied at will.

Depending on the purpose and resulting stresses, thinner or thicker synthetic threads of various strengths can be used. The diameters of the synthetic threads are between 0.3 and 5 mm, for example.

The inventive compounds of gems can be produced in a very simple and economical way and are characterized by a particular esthetic value if thin transparent or colored synthetic threads, for example, are used. The compounds of gems can be used in manifold ways. The free ends of the threads permit simple and reliable attachment in many different ways.

FIG. 2 shows a sheetlike embodiment of compound of gems 1. Individual gems 2 are joined together by longitudinal threads 4 and transverse threads 5 which form a grid 3. Threads 4 and 5 extend in lateral grooves (not shown from the top) in gems 2. Such a sheetlike arrangement is particularly suitable for ornamental purposes or in particular for lighting fixtures.

I claim:

1. A compound of gems comprising a plurality of gems disposed side by side and each having lateral grooves;

a grid holding the gems having longitudinal threads and transverse threads, at least one of the longitudinal threads and the transverse threads being engageable with the lateral grooves in the gems, and the longitudinal threads and transverse threads being made of synthetic material shrinkable by heat to secure the gems in the grid.

2. The compound of gems of claim 1, characterized in that the grid consists of longitudinal threads (4) and transverse threads (5) that are welded together at the points of inter-section (9).

3. A method for producing a compound of gems, characterized by the steps of:

inserting gems having lateral grooves into a grid having longitudinal and transverse threads made of shrinkable synthetic material so that at least one of the longitudinal and transverse threads engage the grooves, and shrinking the threads to secure the gems in the grid.

* * * * *